US008602405B2

(12) United States Patent
Okamoto et al.

(10) Patent No.: US 8,602,405 B2
(45) Date of Patent: Dec. 10, 2013

(54) SHEET ALIGNING MEMBER FOR SHEET PROCESSING APPARATUS

(71) Applicant: Canon Finetech Inc., Misato (JP)

(72) Inventors: Kouji Okamoto, Misato (JP); Yoshihiko Kitahara, Ushiku (JP)

(73) Assignee: Canon Finetech Inc., Misato-shi (JP)

( * ) Notice: Subject to any disclaimer, the term of this patent is extended or adjusted under 35 U.S.C. 154(b) by 0 days.

(21) Appl. No.: 13/772,567

(22) Filed: Feb. 21, 2013

(65) Prior Publication Data

US 2013/0187324 A1 Jul. 25, 2013

Related U.S. Application Data

(62) Division of application No. 12/757,102, filed on Apr. 9, 2010, now Pat. No. 8,439,342.

(30) Foreign Application Priority Data

Apr. 10, 2009 (JP) ..... 2009-096537
Apr. 6, 2010 (JP) ..... 2010-087605

(51) Int. Cl.
*B65H 37/04* (2006.01)

(52) U.S. Cl.
USPC ..... 270/58.11; 270/58.08; 270/58.17

(58) Field of Classification Search
USPC ..... 270/58.08, 58.11, 58.12, 58.16, 58.17
See application file for complete search history.

(56) References Cited

U.S. PATENT DOCUMENTS 5,090,673 A 2/1992 Kitahara et al.
5,365,817 A 11/1994 Maeda et al.
5,599,014 A 2/1997 Kitahara et al.
5,765,824 A * 6/1998 Kawano et al. ..... 270/58.11
6,219,503 B1 4/2001 Miyake et al.
6,330,422 B1 12/2001 Sato et al.
6,353,726 B1 3/2002 Murata et al.
6,371,472 B1 4/2002 Miyake et al.

(Continued)

FOREIGN PATENT DOCUMENTS

JP 05-169396 7/1993
JP 2004269165 A 9/2004

(Continued)

OTHER PUBLICATIONS

Japanese Office Action issued in Counterpart Application No. 2010-087605, mailed Aug. 27, 2013.

*Primary Examiner* — Patrick Mackey
(74) *Attorney, Agent, or Firm* — Fitzpatrick, Cella, Harper & Scinto

(57) ABSTRACT

A sheet processing apparatus has a process tray onto which a sheet is stacked, an aligning member that conveys the sheet toward a sheet edge regulating member in a contact state in which the aligning member, the sheet edge regulating member regulating the edge of the sheet, and a switching member that switches a state of the aligning member between the contact state where the aligning member is in contact with the sheet, and a non-contact state where the aligning member is spaced apart from the process tray. While the sheet on the process tray is being conveyed toward the sheet edge regulating member by the aligning member, the switching member switches the aligning member from the contact state to the non-contact state, and further switches the aligning member from the non-contact state to the contact state.

16 Claims, 13 Drawing Sheets

(56) References Cited

U.S. PATENT DOCUMENTS

| | | | | |
|---|---|---|---|---|
| 6,386,080 | B1 | 5/2002 | Okamoto et al. | |
| 6,505,017 | B2 | 1/2003 | Fujii et al. | |
| 6,517,065 | B2 * | 2/2003 | Miyake et al. | 270/58.09 |
| 6,603,951 | B2 | 8/2003 | Sato et al. | |
| 6,636,720 | B2 | 10/2003 | Fujii et al. | |
| 6,779,790 | B2 | 8/2004 | Kitahara | |
| 7,073,706 | B2 | 7/2006 | Yaginuma et al. | |
| 7,165,764 | B2 * | 1/2007 | Nakamura et al. | 270/58.11 |
| 7,472,901 | B2 * | 1/2009 | Nishimura et al. | 270/58.12 |
| 7,780,159 | B2 * | 8/2010 | Nishimura et al. | 270/58.11 |
| 7,976,004 | B2 * | 7/2011 | Kimura | 270/58.11 |
| 8,104,758 | B2 * | 1/2012 | Tanaka et al. | 270/58.11 |
| 8,123,209 | B2 | 2/2012 | Kubota et al. | |
| 8,439,342 | B2 * | 5/2013 | Okamoto et al. | 270/58.11 |
| 2007/0278732 | A1 | 12/2007 | Kitahara | |
| 2009/0212487 | A1 | 8/2009 | Okamoto et al. | |
| 2011/0057378 | A1 * | 3/2011 | Iguchi et al. | 270/58.11 |

FOREIGN PATENT DOCUMENTS

| | | | |
|---|---|---|---|
| JP | 2006-82153 | | 3/2006 |
| JP | 2007039173 | A | 2/2007 |
| JP | 2007091468 | A | 4/2007 |
| JP | 2009-001393 | A | 1/2009 |

* cited by examiner

SHEET ALIGNING MEMBER FOR SHEET PROCESSING APPARATUS

This application is a divisional of U.S. patent application Ser. No. 12/757,102, filed Apr. 9, 2010, and allowed on Nov. 23, 2012.

BACKGROUND OF THE INVENTION

1. Field of the Invention

The present invention relates to a sheet processing apparatus including an aligning member that aligns sheets on a tray.

2. Description of the Related Art

A sheet processing apparatus is used, for example, by being coupled to an image forming apparatus. The image forming apparatus forms an image on sheets. The sheet processing apparatus is configured to, after receiving the sheets in a process tray as a stack tray, collate the sheets into a bundle form, and perform a stitching operation for such bundle of the sheets by a staple mechanism as processing means. In the event of performing the stitching operation, the sheet processing apparatus conveys the sheets onto the process tray by conveyance rollers as a sheet conveyance unit that conveys the sheets thereonto, and aligns the sheets by hitting the sheets against sheet edge regulating means by using a return roller as an aligning roller. After that, the sheet processing apparatus performs the stitching operation by the staple mechanism. Here, in the vicinity of the sheet edge regulating means, the return roller is arranged so as to be movable up and down by switching means. The return roller is lowered to a contact portion thereof that abuts on the sheets, the sheets are conveyed toward the sheet edge regulating means by the aligning roller, and leading edges of the sheets are hit against the sheet edge regulating means. In such a way, an operation of aligning the sheets is surely performed (refer to Japanese Patent Application Laid-Open No. 2006-82153 and Japanese Patent Application Laid-Open No. H05-169396).

However, in the event of allowing the aligning roller to perform such aligning operation for the trailing edges of the sheets as described above, in some case, the aligning operation for the sheets is not smoothly performed depending on a type of the sheets for use such as recording mediums. For example, in the case where the type of the sheets for use is thick paper (with a basis weight of 105 g/m$^2$ or more), stiffness of the sheets becomes strong. Accordingly, there is a fear that the leading edges of the sheets may collide with a return guide member, and the sheets may not be nipped between the aligning roller and the process tray, causing a conveyance failure. In the case where the type of the sheets for use is coat paper onto which a coating material such as a resin is applied, the sheets become prone to stick on one another by the coating material. Accordingly, there is a fear that conveyance performance for the sheets may become poor, and the alignment of the sheets may turn to a disorder state.

SUMMARY OF THE INVENTION

In this connection, it is an object of the present invention to provide a sheet processing apparatus capable of, with a simple configuration, nicely performing the aligning operation for the sheets conveyed onto the process tray.

Further, in order to achieve the above-mentioned object, according to the present invention, a sheet processing apparatus includes: a process tray onto which a sheet is stacked; an aligning member that conveys the sheet toward a sheet edge regulating member arranged on an upstream end portion of the process tray in a contact state in which the aligning member is in contact with the sheet, the sheet edge regulating member regulating the leading edge of the sheet; and a switching member that switches a state of the aligning member between the contact state where, at a contact position in which the aligning member comes into contact with the sheet conveyed onto the process tray, the aligning member is in contact with the sheet, and a non-contact state where the aligning member is spaced apart from the process tray, wherein the switching member maintains the aligning member in the non-contact state until the sheet reaches the contact position on the process tray, and switches the aligning member from the non-contact state to the contact state after the sheet conveyed onto the process tray reaches the contact position.

In order to achieve the above-mentioned object, according to the present invention, a sheet processing apparatus includes: a process tray onto which a sheet is stacked; an aligning member that conveys the sheet toward a sheet edge regulating member arranged on an upstream end portion of the process tray in a contact state in which the aligning member is in contact with the sheet, the sheet edge regulating member regulating the leading edge of the sheet; and a switching member that switches a state of the aligning member between the contact state where, at a contact position in which the aligning member comes into contact with the sheet conveyed onto the process tray, the aligning member is in contact with the sheet, and a non-contact state where the aligning member is spaced apart from the process tray, wherein, while the sheet on the process tray is being conveyed toward the sheet edge regulating member by the aligning member, the switching member switches the aligning member from the contact state to the non-contact state, and further switches the aligning member from the non-contact state to the contact state.

Further, a sheet processing apparatus includes: a process tray onto which a sheet is stacked; an aligning member that conveys the sheet toward a sheet edge regulating member arranged on an upstream end portion of the process tray in a contact state in which the aligning member is in contact with the sheet, the sheet edge regulating member regulating the leading edge of the sheet; a switching member that switches a state of the aligning member between the contact state where, at a contact position in which the aligning member comes into contact with the sheet conveyed onto the process tray, the aligning member is in contact with the sheet, and a non-contact state where the aligning member is spaced apart from the process tray, the switching member operating in two modes including: a first mode of switching the aligning member from the non-contact state to the contact state before the sheet reaches the contact position on the process tray; and a second mode of maintaining the aligning member in the non-contact state until the sheet reaches the contact position on the process tray, and switching the aligning member from the non-contact state to the contact state after the sheet conveyed onto the process tray reaches the contact position; and a selection member that selects one of the first mode and the second mode so as to cause the switching member to operate.

Still further, a sheet processing apparatus includes: a process tray onto which a sheet is stacked; an aligning member that conveys the sheet toward a sheet edge regulating member arranged on an upstream end portion of the process tray in a contact state in which the aligning member is in contact with the sheet, the sheet edge regulating member regulating the leading edge of the sheet; a switching member that switches a state of the aligning member between a contact state where, at the contact position in which the aligning member comes into contact with the sheet conveyed onto the process tray, the aligning member is in contact with the sheet, and a non-contact state where the aligning member is spaced apart from the process tray, the switching member operating in two modes including: a first mode of switching the aligning member from the non-contact state to the contact state before the sheet reaches the contact position on the process tray; and a second mode of, while the sheet on the process tray is being conveyed toward the sheet edge regulating member by the aligning member, switching the aligning member from the contact state to the non-contact state, and further, switching the aligning member from the non-contact state to the contact state; and a selection member that selects one of the first mode and the second mode so as to cause the switching member to operate.

The switching member switches the aligning member from the non-contact state to the contact state before the sheet reaches the contact position on the process tray. In such a way, the stick of the coat sheet is prevented, and it is possible to convey the thick sheet without causing the leading edge of the thick sheet to collide with the aligning member.

Further, while the sheet on the process tray is being conveyed toward the sheet edge regulating member by the aligning member, the switching member switches the aligning member from the contact state to the non-contact state, and further switches the aligning member from the non-contact state to the contact state. In such a way, the stick of the coat sheet is prevented, and even if the leading edge of the thick sheet collides with the aligning member, the sheet can be nipped between the aligning member and the process tray by switching the state of the aligning member, whereby it is possible to reduce the conveyance failure.

For example, in the case where the type of the sheets for use is the thick paper thicker than the plain paper, the switching member is configured to switch the aligning member from the non-contact state to the contact state before each of the sheets reaches the contact position on the process tray.

According to the present invention having the configuration as described above, when the thick sheet having strong stiffness approaches a return roller as an aligning roller, the return roller is maintained in a raised state. Accordingly, the collision of the leading edge of the thick sheet with the aligning member is avoided, and the apprehension of the damage caused thereon is reduced.

For example, in the case where the type of the sheets for use is the coat paper coated with a coating material such as a resin, while each of the sheets on the process tray is being conveyed toward the sheet edge regulating member by the aligning member, the switching member switches the aligning member from the contact state to the non-contact state, and further switches the aligning member from the non-contact state to the contact state.

According to the present invention having the configuration as described above, the stick of the sheets is prevented, and good conveyance performance is maintained.

By using the present invention as described above, the aligning operation for the sheets conveyed onto the process tray can be nicely performed irrespective of the type of the sheets, and reliability of the sheet processing apparatus can be enhanced.

Further features of the present invention will become apparent from the following description of exemplary embodiments with reference to the attached drawings.

BRIEF DESCRIPTION OF THE DRAWINGS

FIG. 5A is a side explanatory view illustrating a configuration of a switchback roller, FIG. 5B is a side explanatory view illustrating a standby state of the switchback roller, and FIG. 5C is a side explanatory view illustrating a sheet engagement state of the switchback roller.

FIG. 6A is an explanatory view illustrating an entire configuration of the sheet aligning mechanism, FIG. 6B is an explanatory view illustrating a state where a sheet stacking amount is small, FIG. 6C is an explanatory view illustrating a state where the sheet stacking amount is large, FIG. 6D is an explanatory view illustrating a positional relationship between a carry-in guide and a carry-out guide, FIG. 6E is an explanatory view illustrating a structure of kicking means, and FIG. 6F is an explanatory view illustrating a driving mechanism of the kicking means.

DESCRIPTION OF THE EMBODIMENT

Figure 1:
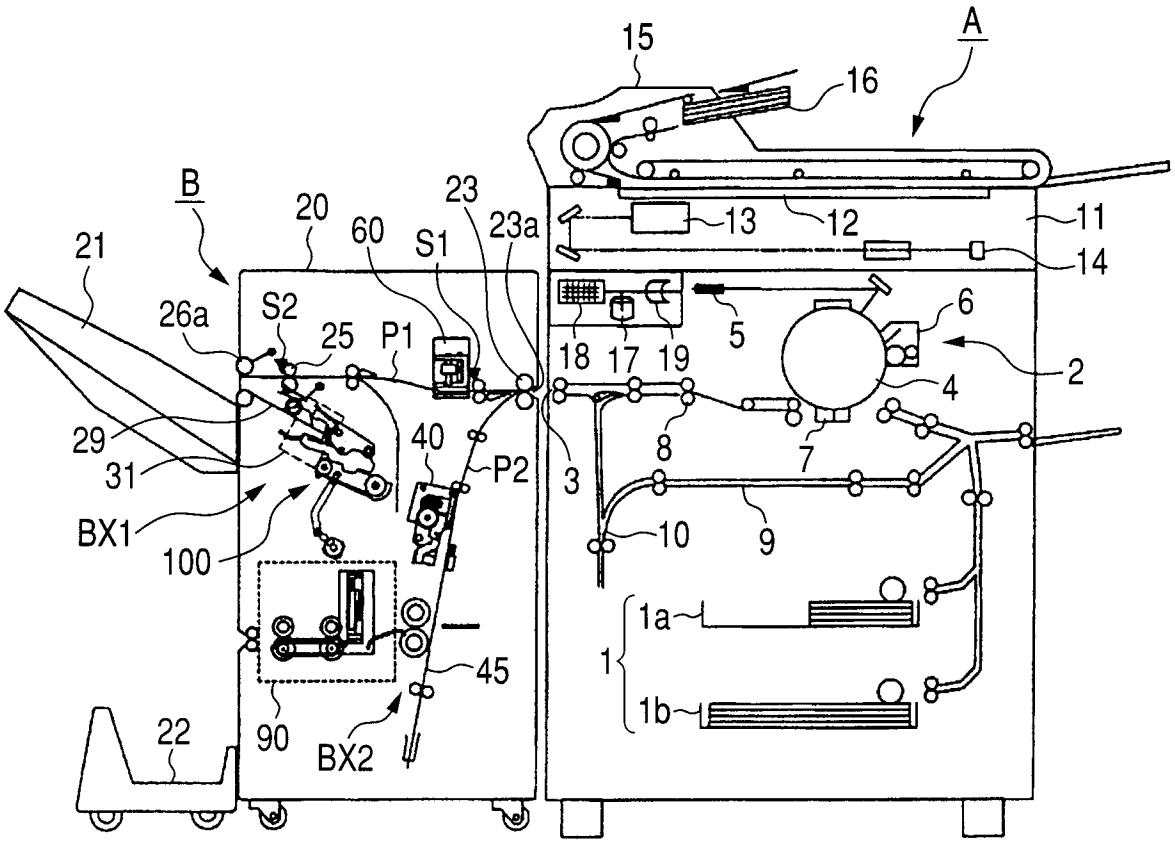
FIG. 1 is a side explanatory view illustrating an example of an entire configuration of an image forming system to which the present invention is applied.

Referring to the drawings, an embodiment is described below in detail, in which the present invention is applied to an image forming system including a sheet processing apparatus B and a copier A as an image forming apparatus.

[Configuration of the Image Forming System]

The image forming system illustrated in FIG. 1 is a system in which the sheet processing apparatus B is coupled to the image forming apparatus A that forms images on sheet-shaped recording mediums such as cut paper. In the image forming system, a carry-in entrance 23*a* of the sheet processing apparatus B is coupled to a sheet discharge outlet 3 of the image forming apparatus A. Further, the image forming system has a configuration in which the sheet-shaped recording mediums having the images formed thereon by the image forming apparatus A are stitched by staple mechanisms BX1 and 40 as processing members of the sheet processing apparatus B, and are stored in a stack tray 21 or a saddle tray 22.

[Configuration of the Image Forming Apparatus]

As illustrated in FIG. 1, the image forming apparatus A in the image forming system as described above is configured so as to feed the sheet-shaped recording mediums such as the cut paper from a sheet feeding section 1 to an image forming section 2, and to discharge the sheet-shaped recording mediums from the sheet discharge outlet 3 after performing printing for the sheet-shaped recording mediums in the image forming section 2. The sheet feeding section 1 includes sheet feeding cassettes 1*a* and 1*b* in which multiple sizes of the sheet-shaped recording mediums are stored. The sheet feeding section 1 separates the designated sheet-shaped recording mediums one by one, and feeds the sheet-shaped recording mediums to the image forming section 2. For example, the image forming section 2 includes a photosensitive drum 4 as a photosensitive member, and a laser emitter 5, a developing device 6, a transfer charger 7, and a fixing device 8, which are arranged on the periphery of the photosensitive drum 4. The image forming section 2 forms each electrostatic latent image on the photosensitive drum 4 by the laser emitter 5, adheres toner onto the electrostatic latent image by the developing device 6, transfers each image to the sheet-shaped recording medium by the transfer charger 7, and heats and fixes the image by the fixing device 8. The sheet-shaped recording mediums on which the images are formed as described above are sequentially carried out from the sheet discharge outlet 3. A circulating path 9 as shown in FIG. 1 is a path for two-side printing of reversing sides of each sheet-shaped recording medium in which the image is printed on a front side, thereafter feeding the sheet-shaped recording medium to the image forming section 2 one more time, and printing the image on a back side of the sheet-shaped recording medium. Here, the sheet-shaped recording medium is fed to the circulating path 9 from the fixing device 8 through a switch-back path 10. The sheet-shaped recording mediums subjected to the two-side printing are carried out in this way.

Further, an image reading apparatus 11 of FIG. 1 scans an original sheet set on a platen 12 with a scan unit 13, and electrically reads the original sheet with a photoelectric conversion element (not shown). The image data is subjected to, for example, digital processing in an image processing section, and then transferred to a storing section 17, and an image signal corresponding to the image data is sent to the laser emitter 5. Further, an original feeding apparatus 15 of FIG. 1 is a feeder apparatus for feeding an original sheet stored in an original tray 16 to the platen 12.

Figure 13:
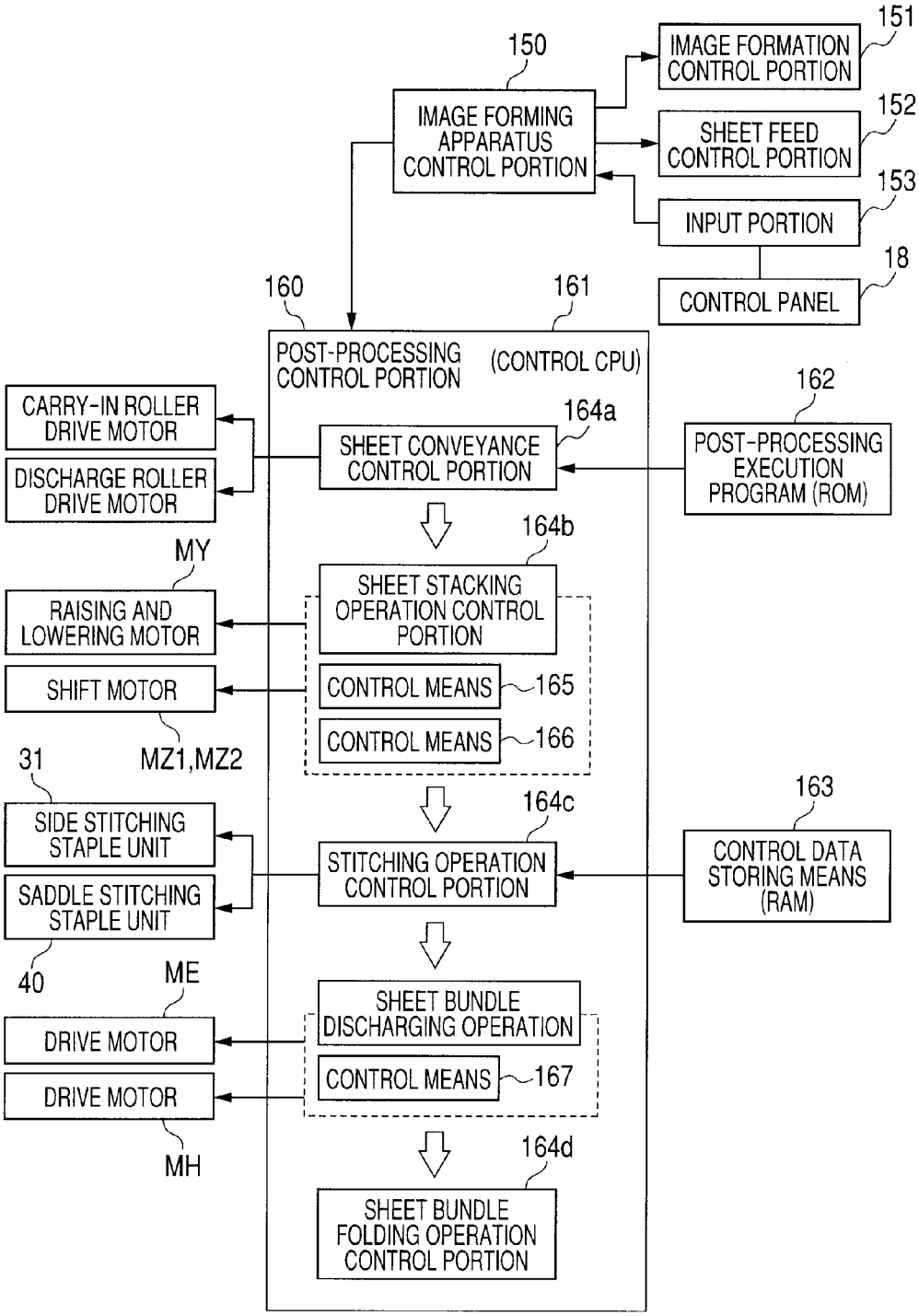
FIG. 13 is a block diagram of a control configuration in the image forming system of FIG. 1.

The image forming apparatus A with the above-mentioned configuration is provided with an image forming apparatus control portion (controller) 150 as illustrated in FIG. 13, and, from a control panel 18, there are set image formation conditions including printing conditions such as sheet size designation, number-of-printed sheet designation, one-side/two-side printing designation, and enlargement/reduction printing designation. Meanwhile, the image forming apparatus A is configured so that image data read by the scan unit 13 or image data transferred from an external network is stored in the data storing section 17, the image data is transferred to a buffer memory 19 from the data storing section 17, and a data signal is sequentially output to the laser emitter 5 from the buffer memory 19.

A post-processing condition is also input and designated from the control panel 18, concurrently with the image formation conditions such as one-side/two-side printing and enlargement/reduction printing. Selected as the post-processing condition in this case is, for example, a "print-out mode", "stitching finish mode", or "brochure finish mode".

[Configuration of the Sheet Processing Apparatus]

The sheet processing apparatus B is configured as described below to receive a sheet-shaped recording medium with the image formed thereon from the sheet discharge outlet 3 of the image forming apparatus A, and to (i) store the sheet-shaped recording medium in the stack tray 21 without post-processing (print-out mode), (ii) collate sheet-shaped recording mediums from the sheet discharge outlet 3 in a bundle form to be stapled, and store the stapled sheet-shaped recording mediums on the stack tray (a first stack tray) 21 (stitching finish mode), or (iii) collate sheet-shaped recording media from the sheet discharge outlet 3 in a bundle form, staple its center of the sheet-shaped recording mediums, fold the stapled sheet-shaped recording mediums in a book form to be stored in the saddle tray (a second stack tray) 22 (brochure finish mode).

Figure 2:
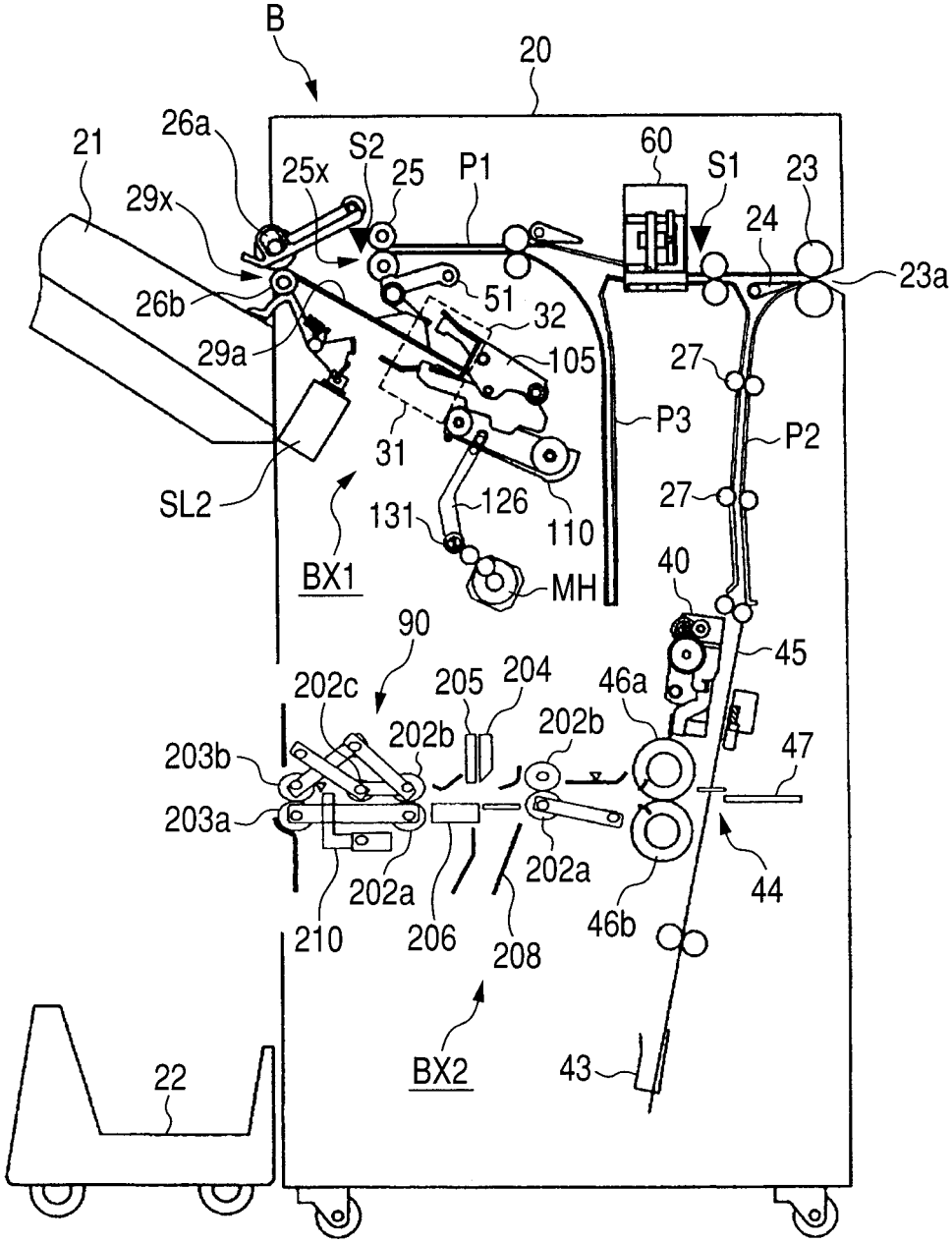
FIG. 2 is an enlarged side explanatory view illustrating an entire configuration of a post-processing apparatus (sheet handling apparatus) of the image forming system illustrated in FIG. 1.

Specifically, as illustrated in FIG. 2 in particular, the carry-in entrance 23*a* is provided on a casing (apparatus frame) 20 of the sheet processing apparatus B, and the carry-in entrance 23*a* is coupled to the sheet discharge outlet 3 of the image forming apparatus A. The casing 20 includes therein the first processing section (processing means) BX1 that stacks and collates, for each set, the sheet-shaped recording mediums coming from the carry-in entrance 23*a*, and performs a stitching finish, and a second processing section (processing means) BX2 that stacks and collates, for each set, the sheet-shaped recording mediums coming from the carry-in entrance 23*a*, and performs a brochure finish. A first conveyance path P1 is provided between the first processing section BX1 and the carry-in entrance 23*a*, and a second conveyance path P2 is provided between the second processing section BX2 and the carry-in entrance 23*a*. In such a way, the sheet-shaped recording mediums coming from the carry-in entrance 23*a* are distributed and guided to the first processing section BX1 and the second processing section BX2. In the vicinity of the carry-in entrance 23*a*, there are provided carry-in rollers 23, a sheet sensor S1, and a path switching member (flapper member) 24 that distributes the sheet-shaped recording mediums to the first and second conveyance paths P1 and P2.

The first conveyance path P1 includes a "buffer path P3" between a punch unit 60 and a process tray 29. When the post-processing such as the staple stitching is performed for a bundle of the stacked sheet-shaped recording mediums (hereinafter, referred to as a sheet bundle) stacked and collated for each set on the process tray 29, the buffer path P3 temporarily stays therein a subsequent sheet-shaped recording medium delivered to the sheet carry-in entrance 23*a* during such operation of the post-processing. Therefore, as illustrated in FIG. 2, the buffer path 3 is disposed to branch off from the first conveyance path P1 in the vertical direction of the casing 20 on the upstream side in the path reaching the process tray 29. Then, the sheet-shaped recording medium from the first conveyance path P1 is switched back and stays in this path. Accordingly, when the post-processing (side stitching processing described later) is performed on a bundle of sheets stacked and collated for each set on the process tray 29, a subsequent sheet-shaped recording medium sent to the carry-in entrance temporary stays, and the subsequent sheet-shaped recording medium in this path can be conveyed to the process tray 29 after the processed sheets on the process tray 29 are carried out.

The first conveyance path P1 is arranged in a substantially horizontal direction in an upper portion of an apparatus housing configured with the casing 20. The first processing section BX1 is arranged downstream of the first conveyance path P1, and the stack tray 21 is arranged downstream of the first processing section BX1. In the first conveyance path P1, the punch unit 60 to be described later is arranged between the carry-in entrance 23*a* and the first processing section BX1. In the first conveyance path P1, sheet discharge rollers 25 and a sheet discharge outlet 25*x* are provided at an outlet end of the first conveyance path P1. A sheet discharge sensor S2 is arranged on the sheet discharge outlet 25*x*. The sheet discharge sensor S2 is configured to detect the sheet-shaped recording mediums passing through the first conveyance path P1, and to detect a jam and count the number of sheets passing therethrough. A difference in level is formed downstream of the sheet discharge outlet 25*x*, and the process tray 29 to be described below is arranged there.

The second conveyance path P2 is arranged in a substantially vertical direction in a lower portion of the casing 20. The second processing section BX2 is arranged downstream of the second conveyance path P2, and the saddle tray 22 is arranged downstream of the second processing section BX2. Further, in the second conveyance path P2, a trimmer unit (a cutting unit) 90 to be described later is arranged close to the saddle tray 22. Still further, in the second conveyance path P2, conveyance rollers 27 are provided. A difference in level is formed downstream of the conveyance rollers 27, and a stacking guide 45 to be described later is arranged there.

[Configuration of the First Processing Section]

Here, the first processing section BX1 which is the above-mentioned processing means is formed of the process tray 29 disposed in the first conveyance path P1, a side stitching unit 31 disposed in the process tray 29, and aligning means 51.

[Configuration of the Process Tray]

Figure 3:
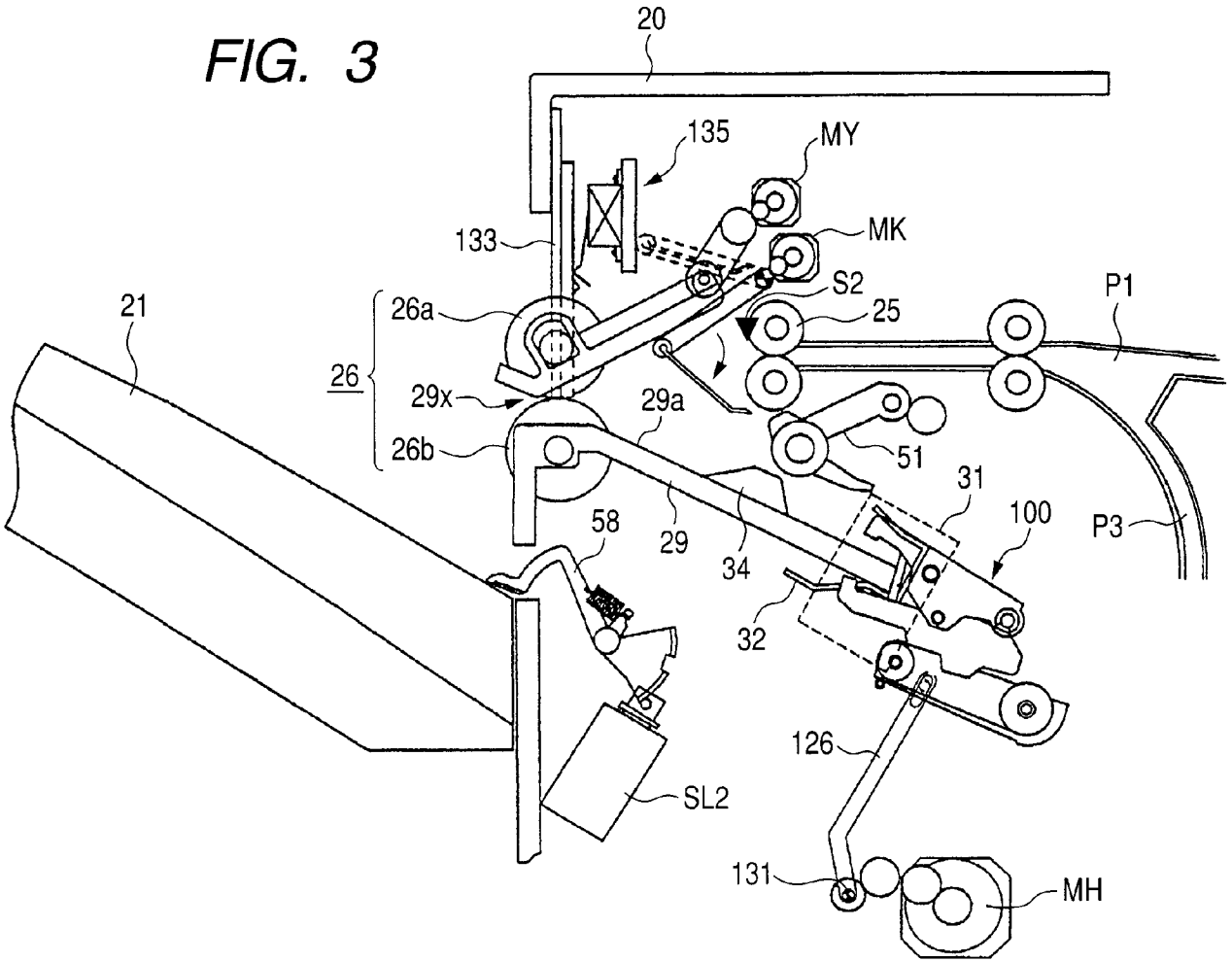
FIG. 3 is a partially enlarged cross-sectional explanatory view illustrating a configuration of a staple unit provided in the post-processing apparatus of FIG. 2, and a structure of a vicinity of the staple unit.

As illustrated in FIG. 3, the process tray 29 thereof is formed of a synthetic resin plate or the like, and is provided with a sheet support surface 29*a* to support sheet-shaped recording mediums stacked on the sheet support surface 29*a*. The sheet support surface 29*a* is disposed to form the difference in level downstream of the sheet discharge outlet 25*x* of the first conveyance path P1, and stores and stacks sheet-shaped recording mediums from the sheet discharge outlet 25*x*. The sheet support surface 29*a* illustrated in FIG. 3 is formed in dimension with a length shorter than the length of the sheet in the sheet discharge direction, and supports the trailing edge portion of the sheet from the sheet discharge outlet 25*x*, while the leading edge portion of the large-size sheet is supported (bridge-supported) on the uppermost sheet on the stack tray 21.

Sheet edge regulating means (a sheet edge regulating member) 32 regulates a leading edge of a sheet. The sheet edge regulating means 32 is provided downstream of the process tray 29 in a conveyance direction. The sheets discharged from the sheet discharge outlet 25*x* are switched back, and leading edges of the sheets are aligned by being hit against the sheet edge regulating means 32. Above the process tray 29, there are arranged switchback rollers (first friction rotating members; the same applies below) 26 (a movable roller 26*a*, a fixed roller 26*b*) which convey, to the sheet edge regulating means 32, the sheet-shaped recording mediums carried onto the process tray 29, aligning means 51, and side aligning means 34.

Each structure is described below.

[Configuration of the Sheet Edge Regulating Means]

Figure 4:
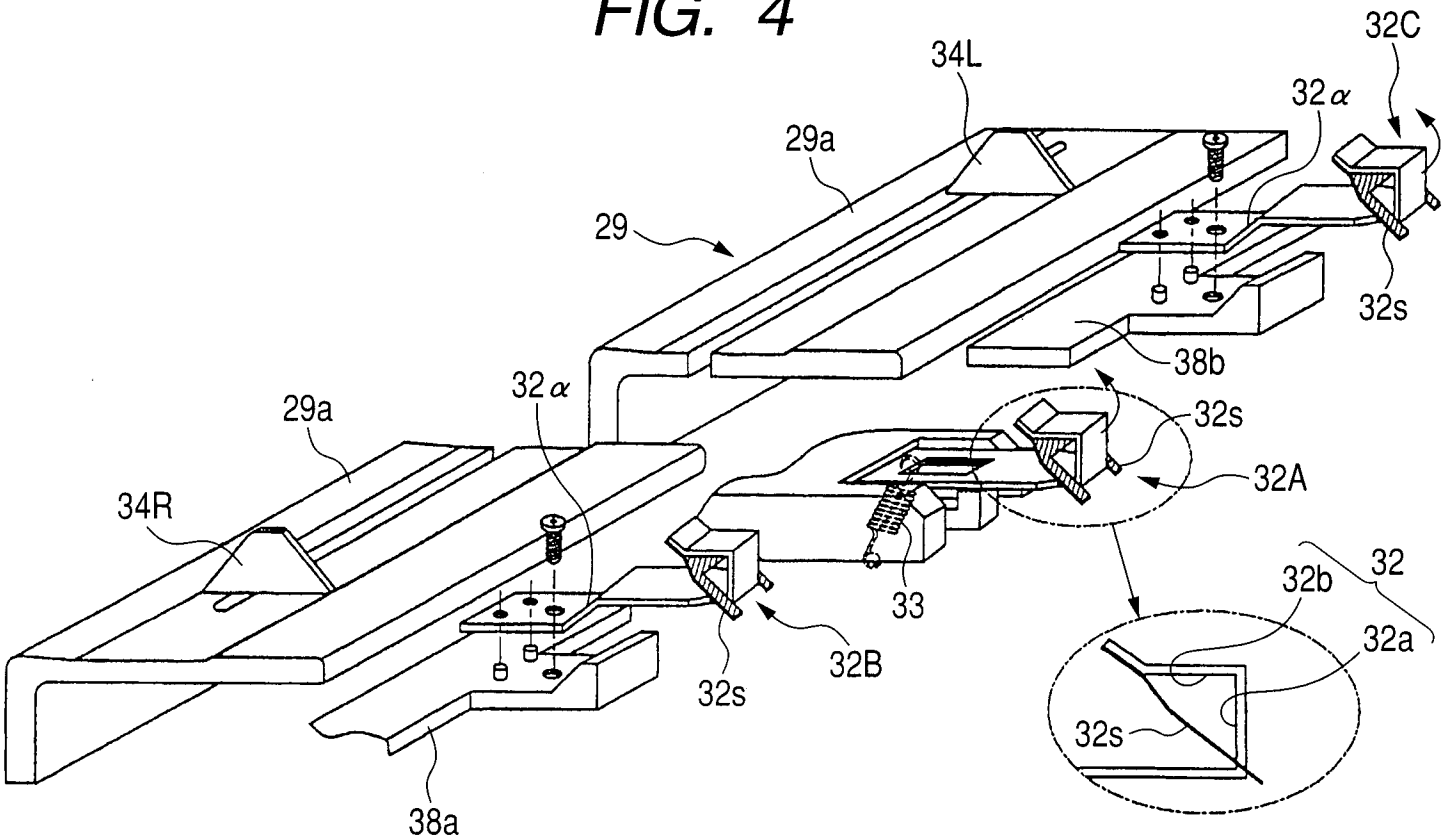
FIG. 4 is a configuration explanatory view of aligning means and trailing edge regulating means of a process tray.

In the process tray 29, the sheet edge regulating means 32 is disposed for positioning one edge of the leading edge and trailing edge of the fed sheet. The sheet edge regulating means 32 illustrated in FIG. 4 is formed of a sheet edge face regulating surface 32*a* with which the leading edge of the sheet is hit against to be regulated, and a stopper member having a sheet upper face regulating surface 32*b* for positioning the top surface of the uppermost sheet to regulate. The sheet edge regulating means 32 is disposed in the rear edge of the process tray 29, hits the leading edge of a sheet fed by the switchback roller 26 and the aligning means 51 described later to regulate, and positions the sheet in a predetermined post-processing position (stitching position, the same applies below). At this point, the sheet upper face regulating surface 32*b* regulates a warped surface of the sheet of which the leading edge curls, while the sheet edge face regulating surface 32*a* positions and regulates the sheet edge.

The sheet edge face regulating surface 32*a* and the sheet upper face regulating surface 32*b* illustrated in FIG. 4 are integrally formed as the stopper member made of resin, metal plate or the like, and may be formed of separate members. In the sheet edge regulating means 32 illustrated in FIG. 4, the fixed stopper member 32A is situated in the center in the sheet width direction, first and second movable stopper members 32B and 32C are situated in the sheet right and left edge portions, the members 32A, 32B, and 32C being arranged at predetermined intervals, and the sheet edge regulating means 32 is constituted by such multiple stopper members and others. In addition, a plate spring 32*s* of FIG. 4 is attached to each stopper member to correct curl at the leading edge of the sheet.

Thus, the first and second movable stopper members 32B and 32C positioned in the sheet right and left edge portions move to positions in accordance with the sheet size. Therefore, with the bottom wall of the process tray 29, there are fitted and supported a right slide member 38*a* and a left slide member 38*b* to be movable in the sheet width direction. Then, the first movable stopper member 32B and the second movable stopper member 32C are fixed to the right and left slide members 38*a* and 38*b*. The right and left slide members 38*a* and 38*b* are coupled to alignment plates 34R and 34L for aligning the sheet side to move in association with the movement of the alignment plates 34R and 34L as described later.

In the sheet edge regulating means 32 configured as described above, at least the sheet upper face regulating surface 32*b* is configured to be able to move up and down in the sheet stacking direction. This is because sheet-bundle carry-out means 100 as described later sometimes raises a bundle of sheets on the process tray 29 upward in carrying out the bundle of sheets on the process tray 29, and the sheet upper face regulating surface 32*b* should be moved upward according to upward movements of the bundle of sheets.

Therefore, as illustrated in FIG. 4, the fixed stopper member 32A is pivotably supported by the bottom wall of the process tray 29, biased downward and supported by a biasing spring 33 as shown in FIG. 4. Further, the first and second movable stopper members 32B and 32C are respectively attached to the right and left slide members 38*a* and 38*b* to be elastically deformable (in a portion indicated by the reference numeral 32α of FIG. 4).

[Configuration of the Sheet Conveying Means]

In the process tray 29, the sheet conveying means (a switchback roller) 26 is disposed for guiding a sheet discharged from the sheet discharge outlet 25*x* to the sheet edge regulating means 32 by performing switchback after temporarily stopping the sheet. The sheet conveying means 26 is formed of a friction rotating member such as a roller, belt, or the like for conveying a sheet fed to the process tray 29 from the sheet discharge outlet 25*x* to the sheet edge regulating means 32. The following description is given according to the switchback roller mechanism as illustrated in FIGS. 5A to 5C.

Figure 5A:
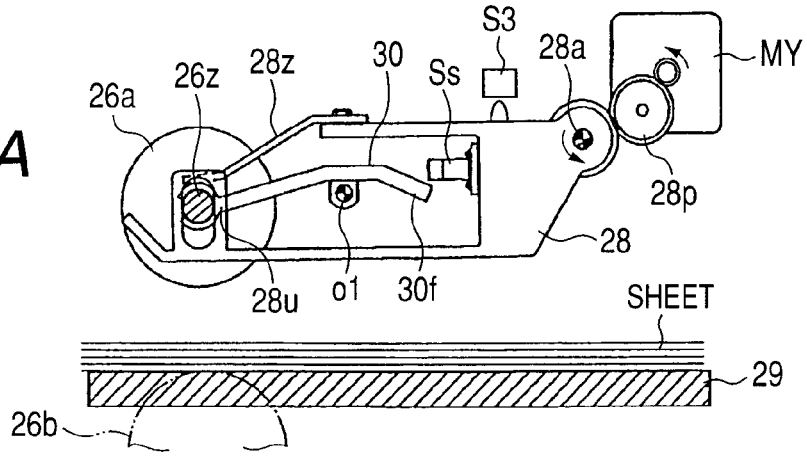
FIGS. 5A, 5B and 5C are explanatory views of a sheet discharge mechanism of the process tray, where
Figure 5B:
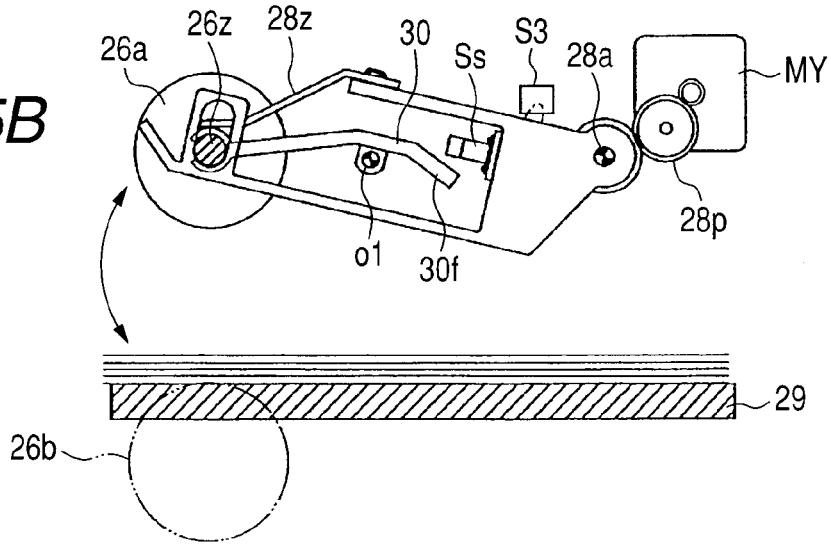
Figure 5C:
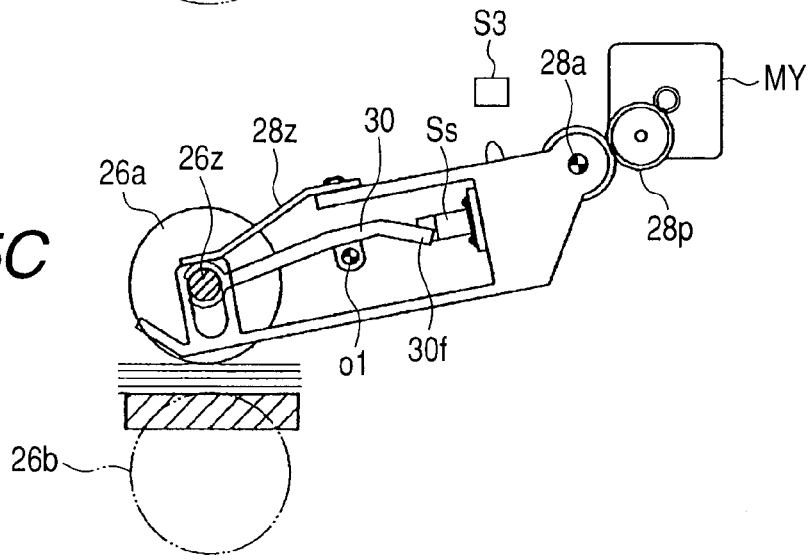
Figure 6A:
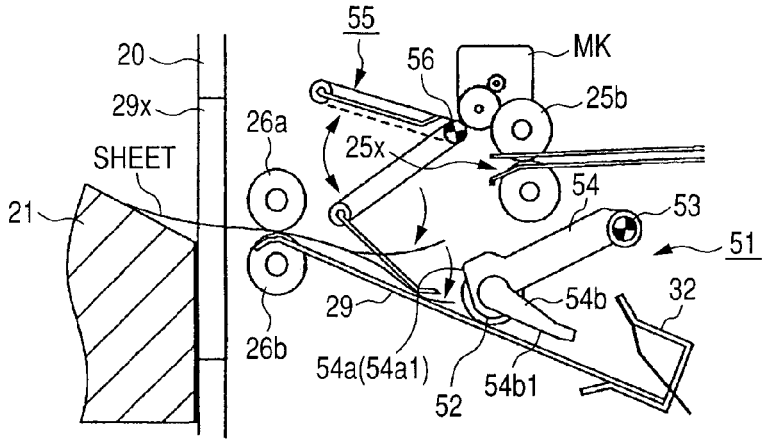
FIGS. 6A, 6B, 6C, 6D, 6E and 6F are explanatory views of a sheet aligning mechanism of the process tray, where
Figure 6B:
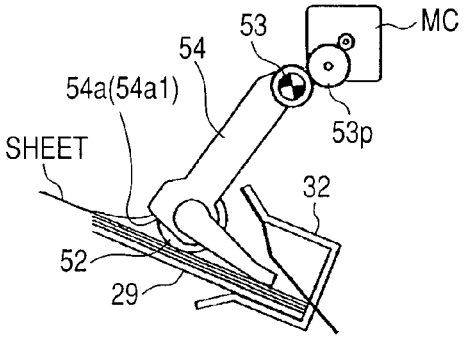
Figure 6C:
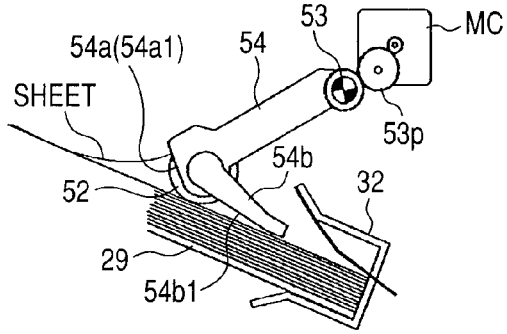
Figure 6D:
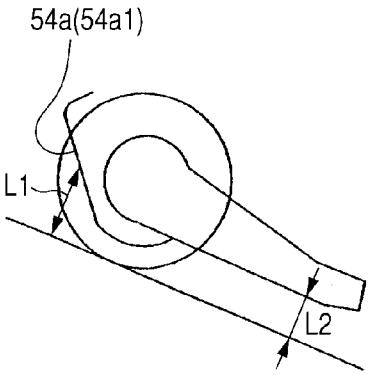
Figure 6E:
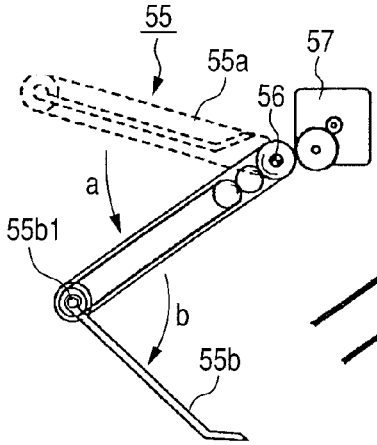
Figure 6F:
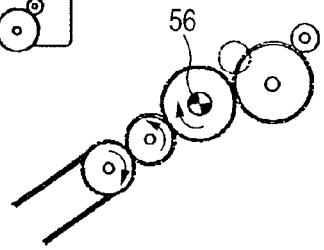

As illustrated in FIGS. 5A to 5C, the switchback roller 26*a* is disposed above the process tray 29, and is configured to convey the sheet discharged from the sheet discharge outlet 25*x* in the forward and reverse directions. Then, the switchback roller 26*a* is pivotally supported by a raising and lowering support arm 28 to move up and down between a contact position (a contact state of FIG. 5C) being in contact with the sheet to be conveyed and a standby position (a non-contact state of FIG. 5B) as a non-contact position separated upward from the sheet. In other words, the raising and lowering support arm 28 is pivotably supported by the apparatus frame (not shown) by a swinging rotary shaft 28*a*, and the swinging rotary shaft 28*a* is coupled to a raising and lowering motor (arm driving means) MY via a pinion 28*p*. In addition, a position sensor S3 is disposed in the vicinity of the raising and lowering support arm 28, and detects a position of the raising and lowering support arm 28 so as to control raising and lowering between the non-contact position and the contact position.

The movable-side switchback roller 26*a* pivotally supported by the raising and lowering support arm 28 is coupled to a forward and reverse motor (not shown) via transmission means (coupling), and rotates forward and reverse in the discharge direction of the sheet conveyed onto the process tray 29 and the opposite direction thereto. Therefore, a roller rotary shaft 26*z* of the switchback roller 26*a* is pivotally supported by a long groove 28*u* formed in the raising and lowering support arm 28 as illustrated in FIG. 5A, and thus pivotally supported to be able to move up and down in the sheet stacking direction (the vertical direction as viewed in FIG. 5A). Then, a paper surface contact sensor Ss is provided in the raising and lowering support arm 28. In addition, a plate spring 28*z* of FIGS. 5A to 5C biases the roller rotary shaft 26*z* always downward, and is to prevent a malfunction of the paper surface detection sensor Ss caused by the shaft floating upward when the switchback roller 26*a* is lowered.

[Paper Surface Contact Sensor]

The raising and lowering support arm 28 is provided with the paper surface contact sensor Ss for detecting a position of the roller rotary shaft 26*z* moving up and down along the long groove 28*u*. The paper surface contact sensor Ss is configured to detect a position of the roller rotary shaft 26*z* traveling (moving upward) in the long groove 28*u* by the contact pressure caused by the switchback roller 26*a* coming into contact with the uppermost sheet on the process tray. Therefore, the raising and lowering arm 28 is provided with a sensor lever 30 having a rotation center o1 in a position different from the swinging rotary shaft 28*a*, and the roller rotary shaft 26*z* is pivotally coupled to the forward end portion of the sensor lever 30. Then, the paper surface contact sensor Ss is formed of a photosensor for detecting a sensor flag 30*f* formed in the rear end portion of the sensor lever 30.

The thus configured switchback roller 26*a* moves up and down between the standby position (FIG. 5B) above the process tray and the operation position (FIG. 5C) being in contact with the sheet conveyed onto the process tray by causing the raising and lowering support arm 28 to pivot up and down by the raising and lowering motor MY. Then, the paper surface contact sensor Ss disposed in the raising and lowering support arm 28 detects that the switchback roller 26*a* comes into contact with the sheet conveyed onto the process tray 29. Such detection of a height of the stacked sheets at this time has been heretofore performed by swinging of a relatively lightweight flag-shaped member. Accordingly, for example, when the sheets are fed at a high speed, and the curled portions occur in the sheets, there is a fear that the flag-shaped member may be stopped by swinging to the actual height of the stacked sheets or more, causing an error in a detection value.

[Configuration of Control Means]

Raising and lowering control means 165 (switching means) for controlling the raising and lowering motor MY is configured as described below. The raising and lowering control means 165 is formed of a control CPU 160 as described later, and controls the raising and lowering support arm 28 to be raised and lowered between the contact position and the non-contact position. First, the raising and lowering control means 165 controls the raising and lowering support arm 28 to rest in the standby position using the position sensor S3 disposed in the vicinity of the raising and lowering support arm 28. Then, an initial operation for determining a height position of the switchback roller 26*a* at the present moment is first executed.

Specifically, as illustrated in FIG. 6, the switchback roller 26*a* provided on the raising and lowering support arm 28 is first started to be lowered together with the raising and lowering support arm 28. When the paper surface contact sensor Ss that detects the position of the roller rotary shaft 26*z* described above is turned on, the switchback roller 26*a* is stopped being lowered. After that, the switchback roller 26*a* are started to be raised together with the raising and lowering support arm 28, and a distance (height) H0 to which the switchback roller 26*a* reaches a certain height position where the paper surface contact sensor Ss is turned off is measured. Such measurement is repeatedly performed multiple times (for example, three times), an average value of multiple measurement values thus obtained is calculated, and the average value is determined and stored as the measured height H0 from the switchback roller 26*b* (lowermost surface). The measured height H0 is defined as a lowering amount for the next first sheet. After that, the switchback roller 26*a* is raised to a home position together with the raising and lowering support arm 28, and is turned to the non-contact state.

In the event of conveying the next first sheet, the leading edge of the sheet carried out from the above-mentioned sheet discharge outlet 25*x* is detected by the sheet sensor S2. After the leading edge of the sheet passes immediately under the switchback roller 26*a*, the raising and lowering motor MY is rotated counterclockwise. Then, the raising and lowering support arm 28 rotates counterclockwise about the swinging rotary shaft 28*a* thereof. In such a way, because the roller rotary shaft 26*z* of the switchback roller 26*a* is supported by the long groove 28*u*, the switchback roller 26*a* is lowered from the non-contact position (FIG. 5B) to the contact position (FIG. 5C) at substantially the same speed as that of the raising and lowering support arm 28. At this time, the sensor lever 30 coupled to the switchback roller 26*a* moves at the same speed as that of the raising and lowering support arm 28. Further, the switchback roller 26*a* at this time is lowered to a predetermined height calculated from the measured height H0 from the above-mentioned tray conveying surface.

Subsequently, the switchback roller 26*a* is started to be raised, and a distance (height) H1 to which the switchback roller 26*a* reaches a certain height position where the paper surface contact sensor Ss for detecting the position of the roller rotary shaft 26*z* is turned off is measured. Such measurement is repeatedly performed multiple times (for example, three times), an average value of multiple measurement values thus obtained is calculated, and the average value is determined and stored as the measured height H1 from the uppermost surface of the stacked sheets. The measured height H1 is defined as a lowering amount for the next second sheet. After that, the switchback roller 26*a* is raised to the home position (height: 22 mm) together with the raising and lowering support arm 28, and is turned to the standby state, and such sheet conveyance operation by the switchback roller 26*a* is similarly performed for the second sheet and after.

As described above, in this embodiment, in the case of conveying an N-th sheet, the leading edge of the sheet carried out from the above-mentioned sheet discharge outlet 25*x* is detected by the sheet sensor S2. Then, after the leading edge of the sheet passes immediately under the switchback roller 26*a*, the switchback roller 26*a* is lowered from the non-contact position (FIG. 5B) to the contact position (FIG. 5C) together with the raising and lowering support arm 28. At this time, when the switchback roller 26*a* is lowered to a predetermined height calculated from a measured height HN−1 from the uppermost surface of the stacked sheet measured at the previous time, the switchback roller 26*a* is stopped being lowered. Then, the switchback roller 26*a* is rotated clockwise illustrated in the drawings, and the leading edge of the sheet is drawn in. After the trailing edge of the sheet passes through the sheet discharge outlet 25*x*, the switchback roller 26*a* is reversed, and the sheet is conveyed to the sheet edge regulating means 32 side in a switch-back manner. In such process of conveying the sheet, the sheet and the switchback roller 26*a* engage with each other with constant pressing force irrespective of the stacking amount of the sheets on the process tray, and predetermined transport force is imparted to the sheet.

Subsequently, the switchback roller 26*a* is started to be raised, and a distance (height) HN to which the switchback roller 26*a* reaches a certain height position where the paper surface contact sensor Ss for detecting the position of the roller rotary shaft 26*z* is turned off is measured. Such measurement is repeatedly performed multiple times (for example, three times), an average value of multiple measurement values thus obtained is calculated, and the average value is determined and stored as the measured height HN from the uppermost surface of the stacked sheets. The measured height HN is defined as a lowering amount for the N+1th sheet. After that, the switchback roller 26*a* is raised to the home position in the non-contact state together with the raising and lowering support arm 28, and such sheet conveyance operation by the switchback roller 26*a* is similarly performed for the N+1th sheet onwards.

At this time, the raising and lowering control unit 165 sets the lowering speed (rotation speed of the raising and lowering motor MY) Va of the raising and lowering support arm 28 to be equal to or slower than the speed (free fall speed) Vr at which the movable switchback roller 26*a* falls inside of the long groove 28*u* with the aid of the gravitational force of the switchback roller 26*a* (Va≤Vr). That is because, when the lowering speed Va of the raising and lowering support arm 28 is set to be faster than the falling speed of the switchback roller 26*a* freely falling inside of the long groove 28*u*, the roller becomes unstable to cause malfunctioning of the paper surface contact sensor Ss through rebounding of the roller. In other words, the speed Vr at which the switchback roller 26*a* falls is limited through the speed of the raising and lowering support arm 28, and the switchback roller 26*a* is thereby lowered gently, whereby the paper surface contact sensor Ss is prevented from erroneous detection due to chattering and the like.

Next, when a peripheral surface of the switchback roller 26*a* comes into contact with the uppermost sheet on the process tray 29, the switchback roller 26*a* is rested on the uppermost sheet, and the raising and lowering support arm 28 rotates and falls in the same direction as that of the switchback roller 26*a*. At this time, the paper surface contact sensor Ss rotates counterclockwise about the swinging rotary shaft 28*a* of the raising and lowering support arm 28. Then, the paper surface contact sensor Ss detects the sensor flag 30*f* of the sensor lever 30, and turns "ON". The raising and lowering motor MY is stopped based on a detection signal of the paper surface contact sensor Ss. By being controlled as described above, the switchback roller 26*a* always comes into contact with the uppermost sheet with constant pressure-contact force (for example, the weight of the switchback roller 26*a*) regardless of whether the stacking amount of the sheets stacked on the process tray 29 is large or small (refer to FIG. 5C).

Substantially simultaneously with the falling of the switchback roller 26*a* to the contact position, the raising and lowering control unit 165 drives the forward and reverse rotation motor (not shown) to rotate the switchback roller 26*a* forward and reverse. Then, the sheet carried onto the uppermost sheet on the process tray 29 from the sheet discharge outlet 25*x* receives constant transport force, and is conveyed in the sheet discharge direction and the direction opposite to the sheet discharge direction. Note that, in the illustrated apparatus, when the sheet from the sheet discharge outlet 25*x* is conveyed from the sheet discharge outlet in the sheet discharge direction, the switchback roller 26*a* is rotated clockwise as illustrated in FIG. 5C, and discharges the sheet to the stack tray 21. After the trailing edge of the sheet passes through the sheet discharge outlet 25*x*, the switchback roller 26*a* is stopped once from the forward rotation, and is thereafter rotated reverse. In such a way, the sheet is conveyed to the sheet edge regulating means 32 side of the process tray 29 in the switch-back manner. In such process of conveying the sheet, the measurement value of the raised amount of the switchback roller 26*a*, which is measured at the previous time, is used as the lowering amount thereof. Accordingly, the sheet and the switchback roller 26*a* engage with each other at the constant pressing force irrespective of the stacking amount of the sheets on the process tray, and predetermined transport force is imparted to the sheet.

With such configuration, for example, even if the sheets are fed at a high speed, and the curled portions occur in the sheets, the sheet conveying means 26*a* is caused to once abut against the uppermost surface of the stacked sheets on the process tray 29, and thereby, in a state in which the sheets have an original stacking height due to the abutting action of the sheet conveying means 26*a*, the detection value of the height of the stacked sheets can be accurately obtained as a reference position for measuring the height.

Here, in this embodiment, the following configuration is adopted. Multiple conveyance modes are set, in which timing when a return roller 51*b* as an aligning member in the present invention moves between a conveying position of conveying the sheets and a non-contact position spaced apart from the conveying position is mutually differentiated, and further, any of multiple conveyance modes is selected, and the sheets are aligned based on the selected mode. In other words, with regard to the sheets discharged onto the process tray 29 as mentioned above, a configuration is adopted, in which the sheets on the process tray 29 are conveyed and aligned based on a predetermined conveyance mode of appropriately vertically moving and rotationally driving the switchback roller 26*a* and the return roller 51*b* as an aligning roller in the present invention. In this case, the above-mentioned raising and lowering control unit 165 is configured so as to switch the conveyance modes depending on types of the sheets (recording mediums) for use. A "plain paper mode", a "thick paper mode" and a "coat paper mode" are set as the conveyance modes.

The plain paper mode is a conveyance mode for sheets as plain paper having a basis weight of 64 g/m$^2$ or more and less than 105 g/m$^2$. The thick paper mode is a conveyance mode for sheets as thick paper having a basis weight of 105 g/m$^2$ or more. The coat paper mode is a conveyance mode for sheets as coat paper having surfaces coated with a coating material such as a resin.

Figure 7:
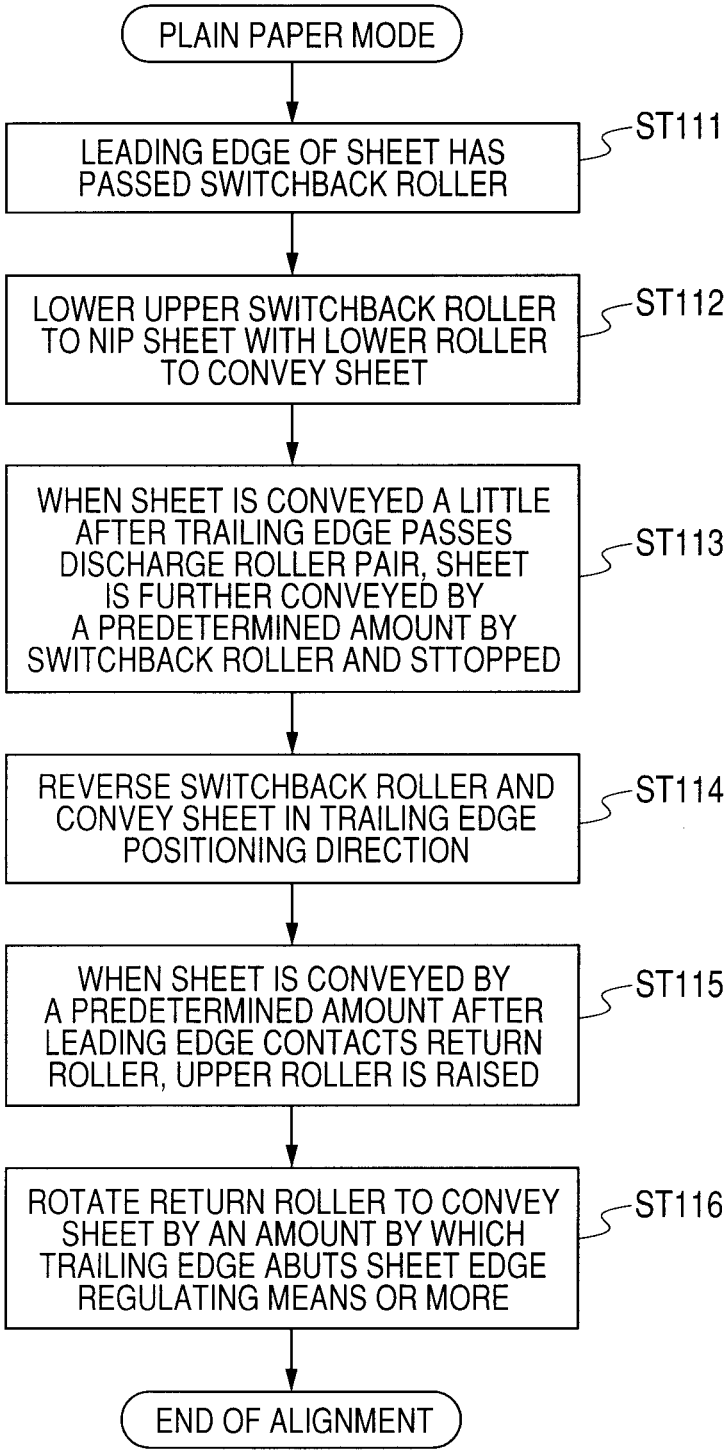
FIG. 7 is a flowchart illustrating conveyance control operations of a "plain paper mode" among conveyance modes for sheets stacked on the process tray.
Figure 8A:
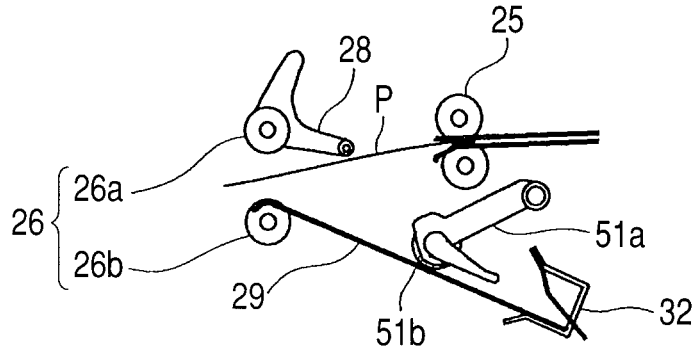
FIGS. 8A, 8B, 8C and 8D are side explanatory views schematically illustrating states of respective stages in the "plain paper mode" illustrated in FIG. 7.
Figure 8B:
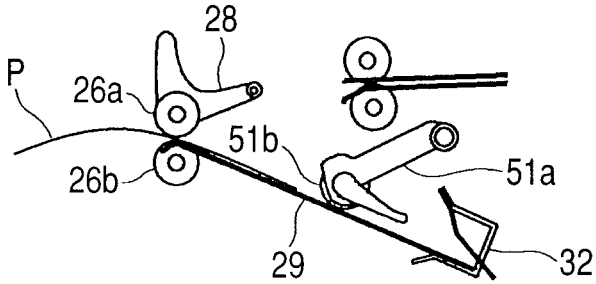

First, in the "plain paper mode" in the case where the type of the sheets (recording mediums) for use is the plain paper, as illustrated in FIG. 7 and FIGS. 8A to 8D, the leading edge of each sheet carried out from the above-mentioned sheet discharge outlet 25*x* is detected by the sheet sensor S2, and then, at timing when the leading edge of the sheet passes the switchback roller 26*a* after passing immediately below the sheet sensor S2 (refer to Step ST111 of FIG. 7 and to FIG. 8A), the switchback roller 26*a* is lowered together with the raising and lowering support arm 28, and nips the sheet with the lower fixed roller 26*b* located on the lower side, and the sheet is then conveyed in the sheet discharge direction by the forward rotation of the switchback roller 26*a* (refer to Step ST112 of FIG. 7 and to FIG. 8B). After the trailing edge of the sheet passes the sheet discharge roller pair 25 and is conveyed a little in such a manner that the sheet is conveyed by the switchback roller 26*a* as described above, the sheet is conveyed by a predetermined amount by the switchback roller 26*a* and is then stopped (refer to Step ST113 of FIG. 7).

Figure 8C:
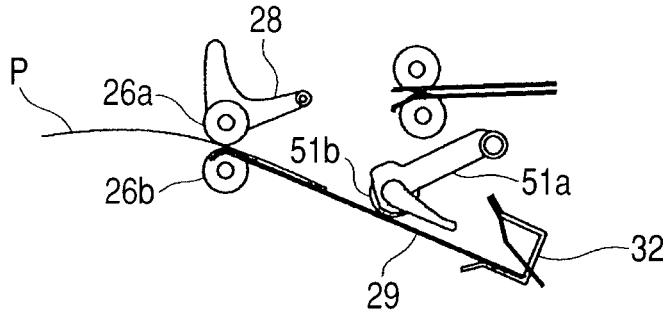
Figure 8D:
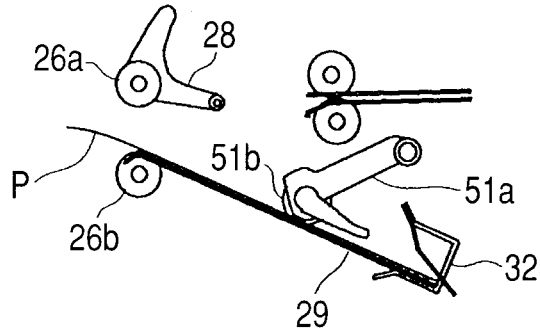

Subsequently, the switchback roller 26*a* is reversed, and the sheet is conveyed on the process tray 29 toward the sheet edge regulating means 32 (refer to Step ST114 of FIG. 7 and to FIG. 8C). At this time, the return roller (aligning roller in the present invention) 51*b* provided on a tip end of a return guide member 51*a* of the aligning means 51 is lowered together with the return guide member 51*a*, and the leading edge of the sheet engages with the return roller 51*b*, and is then fed by a predetermined amount. Then, the switchback roller 26*a* is raised together with the raising and lowering support arm 28 (refer to Step ST115 of FIG. 7 and to FIG. 8D). Then, the above-mentioned return roller 51*b* is rotated, whereby the sheet hits the sheet edge regulating means 32, and after that, the sheet is further conveyed and then stopped. In such a way, the alignment of the sheet is completed (refer to Step ST116 of FIG. 7).

Further, in the "thick paper mode" (FIG. 9) in the case where the type of the sheets (recording mediums) for use is the thick paper, similarly to the above-mentioned "plain paper mode", the leading edge of each sheet carried out from the sheet discharge outlet 25*x* is detected by the sheet sensor S2, and then, at timing when the leading edge of the sheet passes the switchback roller 26*a* after passing immediately below the sheet sensor S2 (refer to Step ST111 of FIG. 7 and to FIG. 8A), the switchback roller 26*a* is lowered together with the raising and lowering support arm 28, and nips the sheet with the lower fixed roller 26*b* located, and the sheet is then conveyed in the sheet discharge direction by the forward rotation of the switchback roller 26*a* (refer to Step ST112 of FIG. 7 and to FIG. 8B). After the trailing edge of the sheet passes the sheet discharge roller pair 25 and is conveyed a little in such a manner that the sheet is conveyed by the switchback roller 26*a* as described above, the sheet is conveyed by a predetermined amount by the switchback roller 26*a* and is then stopped (refer to Step ST113 of FIG. 7 as shown in ST130 of FIG. 9).

Figure 9:
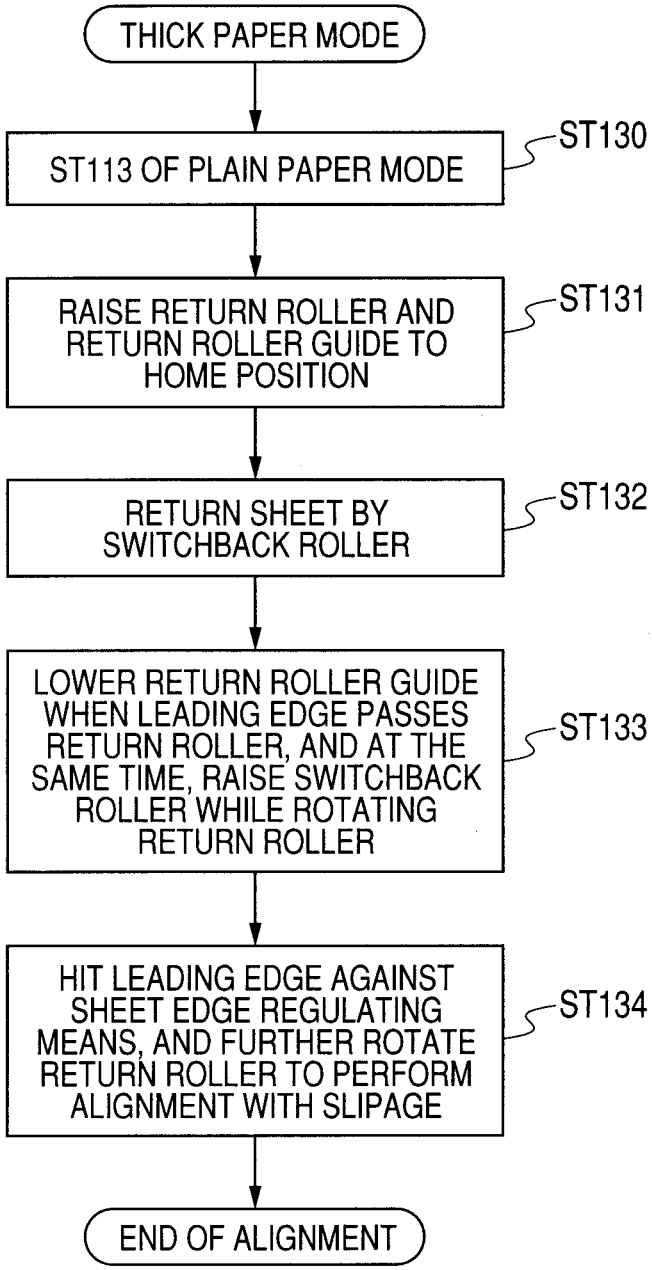
FIG. 9 is a flowchart illustrating conveyance control operations of a "thick paper mode" among the conveyance modes for the sheets stacked on the process tray.
Figure 10A:
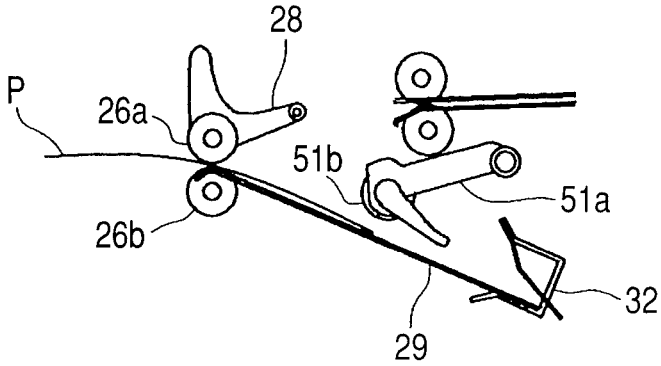
FIGS. 10A and 10B are side explanatory views schematically illustrating states of respective stages in the "thick paper mode" illustrated in FIG. 9.
Figure 10B:
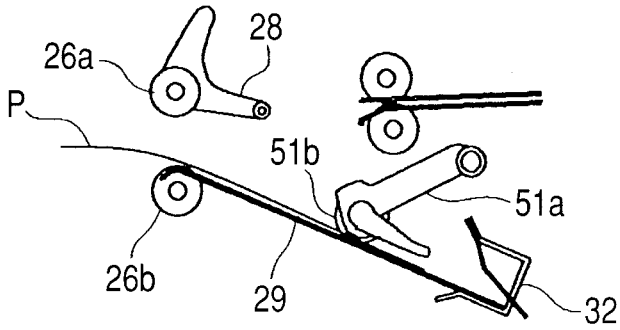

At this time, as illustrated in FIG. 9 and FIGS. 10A and 10B, the return guide member 51*a* of the aligning means 51 is maintained in the non-contact state of leaving raised to the home position together with the return roller 51*b* provided on the tip end of the return guide member 51*a* (refer to Step ST131 of FIG. 9 and to FIG. 10A). That is because, stiffness of the thick paper is high, and hence the leading edge thereof may collide with the return roller 51*b* and the return guide member 51*a* without following an inclination of the process tray 29, resulting in that the sheet may not be conveyed to between the return roller 51*b* and the process tray.

Subsequently, the switchback roller 26*a* is reversed, and the sheet is conveyed on the process tray 29 toward the sheet edge regulating means 32 (refer to Step ST132 of FIG. 9). Then, the return roller 51*b* is lowered in a rotated state when the leading edge of the sheet is conveyed immediately below the return roller 51*b* by the rotation of the switchback roller 26*a*, and at the same time, the switchback roller 26*a* is raised (refer to Step ST133 of FIG. 9 and to FIG. 10B). Then, the sheet hits the sheet edge regulating means 32 by the return roller 51*b*, and after that, the sheet is further conveyed and then stopped. In such a way, the alignment of the sheet is completed (refer to Step ST134 of FIG. 9).

Further, in the "coat paper mode" (FIG. 11) in the case where the type of the sheets (recording mediums) for use is coat paper with coated surfaces, as in the "plain paper mode" as described above, the leading edge of each sheet carried out from the above-mentioned sheet discharge outlet 25*x* is detected by the sheet sensor S2, and then, at timing when the leading edge of the sheet passes the switchback roller 26*a* after passing immediately below the sheet sensor S2 (refer to Step ST111 of FIG. 7 and to FIG. 8A), the switchback roller 26*a* is lowered together with the raising and lowering support arm 28, and nips the sheet with the lower fixed roller 26*b* located on the lower side, and the sheet is then conveyed in the sheet discharge direction by the forward rotation of the switchback roller 26*a* (refer to Step ST112 of FIG. 7 and to FIG. 8B). After the trailing edge of the sheet passes the sheet discharge roller pair 25 and is conveyed a little in such a manner that the sheet is conveyed by the switchback roller 26*a* as described above, the sheet is conveyed by a predetermined amount by the switchback roller 26*a* and is then stopped (refer to Step ST113 of FIG. 7).

Subsequently, the switchback roller 26*a* is reversed, and the sheet is conveyed on the process tray 29 toward the sheet edge regulating means 32 (refer to Step ST114 of FIG. 7 and to FIG. 8C). At this time, the return roller 51*b* provided on a tip end of a return guide member 51*a* of the aligning means 51 is lowered together with the return guide member 51*a*, and the leading edge of the sheet engages with the return roller 51*b*, and is then fed by a predetermined amount. Then, the switchback roller 26*a* is raised together with the raising and lowering support arm 28 (refer to Step ST115 of FIG. 7 and to FIG. 8D). Then, the above-mentioned return roller 51*b* is rotated, whereby the sheet hits the sheet edge regulating means 32, and after that, the sheet is further conveyed and then stopped (refer to Step ST116 of FIG. 7).

Figure 11:
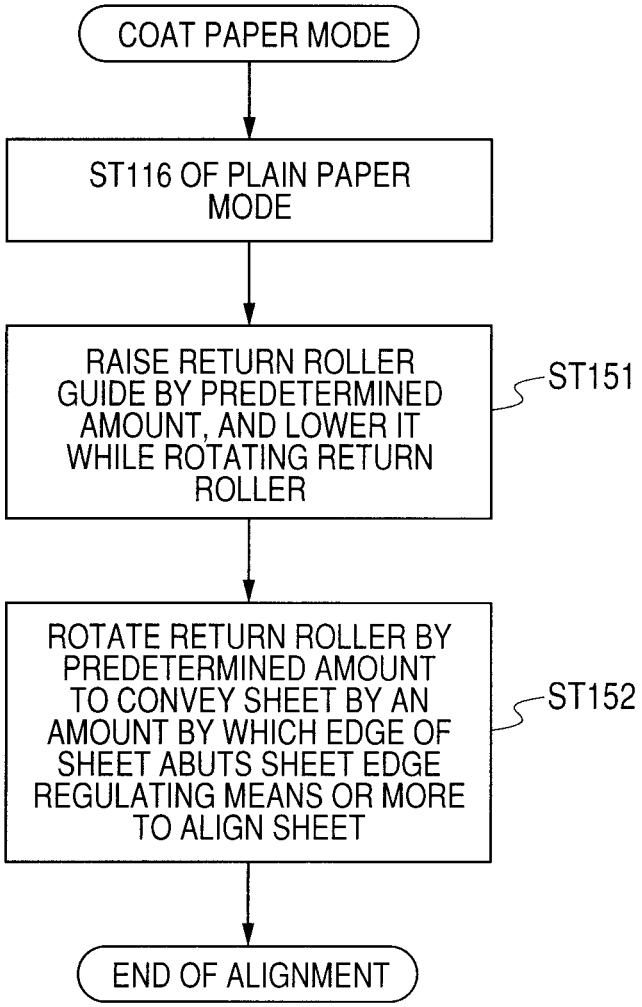
FIG. 11 is a flowchart illustrating conveyance control operations of a "coat paper mode" among the conveyance modes for the sheets stacked on the process tray.
Figure 12A:
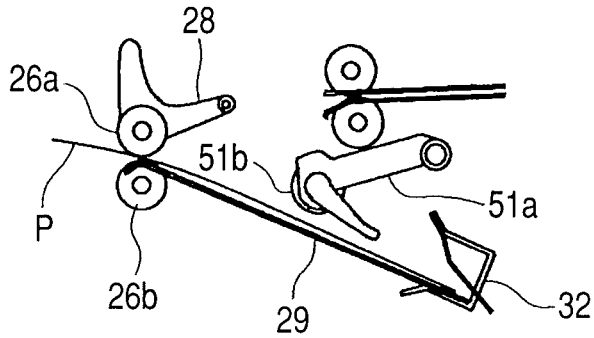
FIGS. 12A and 12B are side explanatory views schematically illustrating states of respective stages in the "coat paper mode" illustrated in FIG. 11.
Figure 12B:
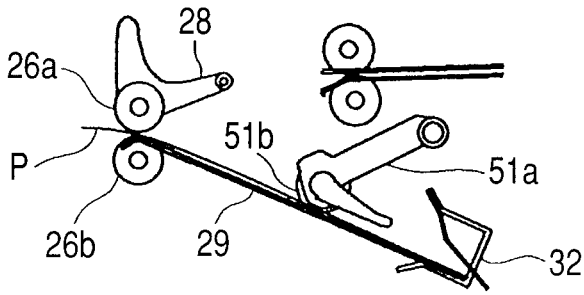

In addition, in this mode, as illustrated in FIG. 11 and FIGS. 12A and 12B, the above-mentioned return roller 51*b* and the return guide member 51*a* are switched from the contact state to the non-contact state, and the return roller in the non-contact state is switched to the contact state while being rotated (refer to Step ST151 of FIG. 11 and to FIG. 12A). Then, after the sheet is surely hits against the sheet edge regulating means 32 by the rotation of the return roller 51*b* and the switchback roller 26*a*, which are in the contact state therewith, the return roller 51*b* and the switchback roller 26*a* are stopped (refer to Step ST152 of FIG. 11 and to FIG. 12B). That is because, depending on a type of the coating material on the coat sheets, the coat sheets are prone to stick on one another, and conveyance performance for the sheets is poor, and accordingly, a peeling operation for the sheets is performed by vertically moving the return roller 51*b*.

Further, as the peeling operation for each of the sheets, in a state where the leading edge of the sheet is located between the contact position and the sheet edge regulating means, the return roller 51*b* is switched from the contact state to the non-contact state, and is further switched from the non-contact state to the contact state. Also in such a way, the same effect can be obtained.

As described above, this embodiment is configured so as to change the conveyance mode upon stacking the sheets on the process tray 29 to any of the "plain paper mode", the "thick paper mode", and the "coat paper mode" based on the type of the sheets for use. In the case where the type of the sheets is changed while the sheets are being stacked, the conveyance mode is changed in response to the change of the type of the sheets. However, for the first sheet immediately after the mode is changed, the previous mode (old mode) is implemented. For example, in the case where the conveyance mode is changed from the coat paper mode to the plain paper mode while the sheets are being stacked, the first sheet of the plain paper is conveyed in the coat paper mode, and the second sheet of the plain paper and subsequent sheets are conveyed in the plain paper mode. However, in the case where the conveyance mode is changed from the coat paper mode to the thick paper mode, a first half of the first sheet of the thick paper is conveyed on the thick paper mode in a state where the return roller is raised, and a second half thereof is conveyed on the coat paper mode without raising the swing roller.

Further, even in the case of using the thick paper mode for the coat paper (coat sheets), the stick of the coat sheets is prevented, and it is possible to reduce the apprehension that the leading edge of each of the coat sheets may collide with the aligning member and be damaged. Reasons for this are as follows. Specifically, the above-mentioned switching means switches the aligning member from the non-contact state to the contact state until the sheet reaches the contact position on the stack tray, whereby it is possible to peel the stuck coat sheet with an impact generated when the aligning member comes into contact in the contact position.

Further, even in the case of using the coat paper mode for the thick paper (thick sheets), it is possible to convey each of the thick sheets even if the leading edge thereof collides with the aligning member. Reasons for this are as follows. Specifically, while each of the thick sheets on the stack tray is being conveyed toward the sheet edge regulating means by the aligning member, the switching member switches the aligning member from the contact state to the non-contact state, and further, switches the aligning member from the non-contact state to the contact state, whereby, even if the leading edge of the thick sheet collides with the aligning member, it is possible to nip the sheet between the aligning member and the stack tray, and to reduce the conveyance failure.

[Description of the Control Configuration]

A control configuration of the image forming system as described above is described below with reference to a block diagram of FIG. 13. The image forming system illustrated in FIG. 1 includes a control portion (hereinafter referred to as "main body control portion") 150 of the image forming apparatus A and a control portion (hereafter referred to as "post-processing control portion") 160 of the post-processing apparatus B. The main body control portion 150 includes an image formation control portion 151, a sheet feed control portion 152, and an input portion 153. Then, the settings of "image formation mode" and "post-processing mode" are made from a control panel 118 provided in the input portion 153. As described above, the image formation mode is to set image formation conditions such as the number of print out sets, sheet size, enlargement/reduction printing, one-side/two-side printing, and others. Then, the main body control portion 150 controls the image formation control portion 151 and the sheet feed control portion 152 corresponding to the set image formation conditions, forms an image on a predetermined sheet, and then, sequentially discharges the sheet from the main-body sheet discharge outlet 3.

Concurrently therewith, the post-processing mode is set by input from the control panel 118. For example, the "print-out mode", "staple stitching finish mode", "sheet-bundle folding finish mode", or the like is set. At this time, when the type of the sheets is special paper (thick paper, coat paper), the type of the sheets is input, and the conveyance mode is set to any one of the "plain paper mode", the "thick paper mode", and the "coat paper mode". Accordingly, the main body control portion 150 transfers, to the post-processing control portion 160, information on the finish mode, the number of sheets, and the number of sets in the post-processing, and information on a stitching mode (one-portion stitching, two-portion stitching, or multiple-portion stitching). Simultaneously therewith, the main body control portion 150 transfers a job finish signal to the post-processing control portion 160 as selection means whenever the image formation is completed.

The post-processing control portion 160 includes the control CPU 161 for operating the post-processing apparatus B corresponding to the designated finish mode, a ROM 162 for storing an operation program, and a RAM 163 for storing control data. Then, the control CPU 161 includes a sheet conveyance control portion 164*a* for executing conveyance of a sheet sent to the carry-in entrance 23*a*, a sheet stacking operation control portion 164*b* for executing the operation of stacking sheets, a stitching operation control portion 164*c* for executing sheet stitching processing, and a sheet bundle folding operation control portion 164*d* for executing the operation of folding a bundle of sheets.

The sheet conveyance control portion 164*a* is coupled to a control circuit of drive motors (not shown) of the carry-in roller 23 and the sheet discharge roller 25 of the first conveyance path P1, and is configured to receive a detection signal from the sheet sensor S1 disposed in this conveyance path. Further, the sheet stacking operation control portion 164*b* is connected to the forward and reverse rotation motor of the switchback roller 26*a* and a driving circuit of a shift motor of the sheet edge regulation member to gather sheets on the process tray 29. Further, the stitching operation control portion 164*c* is connected to a driving circuit of drive motors MD incorporated into the side stitching unit 31 of the process tray 29 and into the saddle stitching staple unit 40 of the stacking guide 45.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications No. 2009-096537, filed Apr. 10, 2009, and No. 2010-087605, filed on Apr. 6, 2010 which are hereby incorporated by reference herein in their entirety.

What is claimed is:

1. A sheet processing apparatus, comprising:

a process tray onto which a sheet is stacked;

an aligning member that conveys the sheet toward a sheet edge regulating member in a contact state in which the aligning member is in contact with the sheet, the sheet edge regulating member regulating the edge of the sheet; and a switching member that switches a state of the aligning member between the contact state where, at a contact position in which the aligning member comes into contact with the sheet conveyed onto the process tray, the aligning member is in contact with the sheet, and a non-contact state where the aligning member is spaced apart from the process tray, wherein, while the sheet on the process tray is being conveyed toward the sheet edge regulating member by the aligning member, the switching member switches the aligning member from the contact state to the non-contact state, and further switches the aligning member from the non-contact state to the contact state.

2. A sheet processing apparatus according to claim 1, further comprising a processing member that processes the sheet on the process tray.

3. A sheet processing apparatus according to claim 2, wherein the processing member is a staple mechanism that stitches sheets on the process tray.

4. A sheet processing apparatus, comprising:

a process tray onto which a sheet is stacked;

an aligning member that conveys the sheet toward a sheet edge regulating member in a contact state in which the aligning member is in contact with the sheet, the sheet edge regulating member regulating the edge of the sheet;

a switching member that switches a state of the aligning member between the contact state where, at a contact position in which the aligning member comes into contact with the sheet conveyed onto the process tray, the aligning member is in contact with the sheet, and a non-contact state where the aligning member is spaced apart from the process tray, the switching member operating in two modes include: a first mode of switching the aligning member from the non-contact state to the contact state before the sheet reaches the contact position on the process tray; and a second mode of maintaining the aligning member in the non-contact state until the sheet reaches the contact position on the process tray, and switching the aligning member from the non-contact state to the contact state after the sheet conveyed onto the process tray reaches the contact position; and a selection member that selects one of the first mode and the second mode, wherein the switching member operates in response to a mode selected by the selection member.

5. A sheet processing apparatus according to claim 4, further comprising a processing member that processes the sheet on the process tray.

6. A sheet processing apparatus according to claim 5, wherein the processing member is a staple mechanism that stitches sheets on the process tray.

7. A sheet processing apparatus according to claim 4, wherein the selection member selects one of the first mode and the second mode based on a type of the sheet conveyed onto the process tray.

8. A sheet processing apparatus according to claim 7, wherein the selection member selects the first mode in a case where the type of the sheet is plain paper.

9. A sheet processing apparatus according to claim 7, wherein the selection member selects the second mode in a case where the type of the sheet is thick paper.

10. A sheet processing apparatus, comprising:

a process tray onto which a sheet is stacked;

an aligning member that conveys the sheet toward a sheet edge regulating member in a contact state in which the aligning member is in contact with the sheet, the sheet edge regulating member regulating the edge of the sheet;

a switching member that switches a state of the aligning member between the contact state where, at a contact position in which the aligning member comes into contact with the sheet conveyed onto the process tray, the aligning member is in contact with the sheet, and a non-contact state where the aligning member is spaced apart from the process tray, the switching member operating in two modes including: a first mode of switching the aligning member from the non-contact state to the contact state before the sheet reaches the contact position on the process tray; and a second mode of, while the sheet on the process tray is being conveyed toward the sheet edge regulating member by the aligning member, switching the aligning member from the contact state to the non-contact state, and further, switching the aligning member from the non-contact state to the contact state; and a selection member that selects one of the first mode and the second mode, wherein the switching member operates in response to a mode selected by the selection member.

11. A sheet processing apparatus according to claim 10, further comprising a processing member that processes the sheet on the process tray.

12. A sheet processing apparatus according to claim 11, wherein the processing member is a staple mechanism that stitches sheets on the process tray.

13. A sheet processing apparatus according to claim 10, wherein the selection member selects one of the first mode and the second mode based on a type of the sheet conveyed onto the process tray.

14. A sheet processing apparatus according to claim 13, wherein the selection member selects the first mode in a case where the type of the sheet is plain paper.

15. A sheet processing apparatus according to claim 13, wherein the selection member selects the second mode in a case where the type of the sheet is coat paper.

16. A sheet processing apparatus according to claim 15, wherein the selection member selects the second mode in a case of stacking another type of sheet on the coat paper stacked on the process tray.

* * * * *